US009062911B2

(12) United States Patent
Keller et al.

(10) Patent No.: US 9,062,911 B2
(45) Date of Patent: Jun. 23, 2015

(54) REFRIGERATION DEVICE COMPRISING A DOOR-OPENING AID

(75) Inventors: Hans Gerd Keller, Giengen (DE); Arnd Krusche, Shenzhen (CN); Heinrich Müller, Tuttlingen (DE)

(73) Assignee: BSH HAUSGERÄTE GMBH, Munich (DE)

( * ) Notice: Subject to any disclaimer, the term of this patent is extended or adjusted under 35 U.S.C. 154(b) by 882 days.

(21) Appl. No.: 12/518,994

(22) PCT Filed: Nov. 22, 2007

(86) PCT No.: PCT/EP2007/062718

§ 371 (c)(1),
(2), (4) Date: Jul. 23, 2010

(87) PCT Pub. No.: WO2008/077703

PCT Pub. Date: Jul. 3, 2008

(65) Prior Publication Data

US 2010/0307189 A1 Dec. 9, 2010

(30) Foreign Application Priority Data

Dec. 22, 2006 (DE) ..... 10 2006 061 083

(51) Int. Cl.
*A47B 96/04* (2006.01)
*F25D 23/02* (2006.01)
(Continued)

(52) U.S. Cl.
CPC ..... *F25D 23/028* (2013.01); *A47B 2088/0077* (2013.01); *E05F 11/54* (2013.01);
(Continued)

(58) Field of Classification Search
CPC ..... E05F 15/00; E05F 15/60; E05F 15/70; E05F 15/73; E05Y 2201/426; E05Y 2900/31; E05Y 2400/44; E05Y 2400/852; F25D 23/028; F25D 2323/02; F25D 2700/02; F25D 2700/04
USPC ..... 312/296, 405; 292/DIG. 71; 49/276, 49/364, 137, 324, 356; 277/644–645, 277/648–649, 317
See application file for complete search history.

(56) References Cited

U.S. PATENT DOCUMENTS 4,691,195 A * 9/1987 Sigelman et al. ..... 340/545.4
4,698,876 A * 10/1987 Karita ..... 16/102
(Continued)

FOREIGN PATENT DOCUMENTS

CN 1127349 A 7/1996
DE 3423132 C1 * 1/1986 ..... E05F 15/20
(Continued)

OTHER PUBLICATIONS

Translation of DE 34323132 C1.*
(Continued)

*Primary Examiner* — Daniel J Troy
*Assistant Examiner* — Andrew Roersma
(74) *Attorney, Agent, or Firm* — Nixon & Vanderhye P.C.

(57) ABSTRACT

A refrigeration device is provided that includes two housing parts in the form of a body and a door that together delimit an interior. A seal is fastened to one of the housing parts and sealingly contacts the other housing part when the door is closed and a drive element is arranged to drive the door from the closed position into an open position. A sensor detects a movement of the door and a control circuit coupled to the sensor activates the drive element when a movement of the door is detected.

14 Claims, 2 Drawing Sheets

(51) Int. Cl.

| | |
|---|---|
| ***F25D 17/04*** | (2006.01) |
| ***A47B 88/00*** | (2006.01) |
| ***E05F 11/54*** | (2006.01) |
| ***E05F 15/60*** | (2015.01) |
| ***E05F 15/73*** | (2015.01) |

(52) U.S. Cl.

CPC ..... *E05Y2800/113* (2013.01); *E05Y 2900/31* (2013.01); *F25D 17/047* (2013.01); *F25D 2700/02* (2013.01); *E05Y 2900/20* (2013.01); *E05F 15/60* (2015.01); *E05F 15/73* (2015.01)

(56) References Cited

U.S. PATENT DOCUMENTS

| | | | | | |
|---|---|---|---|---|---|
| 4,707,684 | A * | 11/1987 | Janke et al. | ..... | 340/530 |
| 4,884,412 | A * | 12/1989 | Sellers et al. | ..... | 62/115 |
| 5,988,709 | A * | 11/1999 | Lee et al. | ..... | 292/199 |
| 6,038,930 | A * | 3/2000 | Lehnen et al. | ..... | 73/774 |
| 6,230,137 | B1 * | 5/2001 | Has et al. | ..... | 704/275 |
| 6,233,872 | B1 * | 5/2001 | Glagow et al. | ..... | 49/27 |
| 6,338,536 | B1 | 1/2002 | Ueno et al. | | |
| 6,525,659 | B2 * | 2/2003 | Jaffe et al. | ..... | 340/545.6 |
| 6,533,375 | B2 * | 3/2003 | Fulterer et al. | ..... | 312/319.8 |
| 6,802,186 | B2 * | 10/2004 | Holmes et al. | ..... | 62/187 |
| 6,811,236 | B1 * | 11/2004 | Spong et al. | ..... | 312/405 |
| 6,896,268 | B2 * | 5/2005 | Hofmann et al. | ..... | 277/317 |
| 6,945,363 | B2 * | 9/2005 | Angst et al. | ..... | 187/317 |
| 7,005,983 | B2 * | 2/2006 | Holmes et al. | ..... | 340/545.6 |
| 7,051,560 | B2 * | 5/2006 | Sanchirico et al. | ..... | 70/92 |
| 2003/0025424 | A1 * | 2/2003 | Graves | ..... | 312/198 |
| 2003/0057651 | A1 * | 3/2003 | Nantua et al. | ..... | 277/351 |
| 2004/0103584 | A1 * | 6/2004 | Freeman | ..... | 49/334 |
| 2004/0183413 | A1 * | 9/2004 | Koo | ..... | 312/401 |
| 2005/0108945 | A1 * | 5/2005 | Wiemer et al. | ..... | 49/278 |
| 2005/0269334 | A1 * | 12/2005 | Bang et al. | ..... | 220/581 |
| 2006/0010890 | A1 * | 1/2006 | Feinauer et al. | ..... | 62/169 |
| 2006/0097612 | A1 * | 5/2006 | Park | ..... | 312/405 |
| 2006/0103282 | A1 * | 5/2006 | Avendano et al. | ..... | 312/401 |
| 2006/0107597 | A1 * | 5/2006 | Jin et al. | ..... | 49/149 |
| 2006/0117661 | A1 * | 6/2006 | Hansson et al. | ..... | 49/26 |
| 2006/0185252 | A1 * | 8/2006 | Dries | ..... | 49/460 |
| 2006/0242908 | A1 * | 11/2006 | McKinney | ..... | 49/280 |
| 2008/0231158 | A1 * | 9/2008 | Keller et al. | ..... | 312/405 |

FOREIGN PATENT DOCUMENTS

| | | | | | |
|---|---|---|---|---|---|
| DE | 102004012496 | A1 | 10/2005 | | |
| DE | 202005006945 | U1 | 6/2006 | | |
| JP | 2006046837 | A * | 2/2006 | ..... | F25D 23/02 |
| WO | 2004101919 | A1 | 11/2004 | | |
| WO | WO 2006120071 | A1 * | 11/2006 | ..... | F25D 17/04 |
| WO | WO 2006120084 | A2 * | 11/2006 | ..... | F25D 17/04 |
| WO | 2007042933 | A1 | 4/2007 | | |

OTHER PUBLICATIONS

Translation of WO 2006120071 A1.*
Translation of WO 2006120084 A2.*
DE202005006945U1—Human Translation.*
PTC Heating Elements (Mar. 26, 2006).*

* cited by examiner

REFRIGERATION DEVICE COMPRISING A DOOR-OPENING AID

This application is a U.S. National Phase of International Application No. PCT/EP2007/062718, filed Nov. 22, 2007, which designates the U.S. and claims priority to German Application No. 102006061083.0, filed Dec. 22, 2006, the entire contents of each are hereby incorporated by reference.

BACKGROUND OF THE INVENTION

The present invention relates to a refrigeration device with a door-opening aid, or to put it more precisely, to a device with two housing parts, namely a carcass and a door, which delimit an interior, a seal which is attached to one of the housing parts and which, when the door is closed, touches the other door to form a seal with it, and a drive element which is arranged to drive the door out of its closed position. Such a refrigeration device is known for example from DE 10 2004 012496 A1.

Warm air which penetrates into the inside of the device when the door is opened cools off when the door is subsequently closed and results in a vacuum which makes it difficult to open the door again. Since the drive element relieves the sealing contact between the other housing part and the seal, it makes it possible to equalize the pressure, so that the same drive element or a user can open the door with little effort.

EP 10 77 354 A2 describes a further refrigeration device of the type mentioned above. To control the operation of the drive element, a switch which must be operated by a user to activate the drive element is provided on a door handle in this refrigeration device.

A disadvantage of this known refrigeration device is that it can essentially only be realized without problems with a freestanding device. With a freestanding device door and handle form one complete unit installed by the manufacturer of the device. This is not the case with built-in devices. This is because these devices generally have a door without a handle which is covered during the installation of the device by a furniture décor panel, and a handle is generally attached to the decor panel, the appearance of which is predetermined by an adjoining front decor panels. The manufacturer of the refrigeration device has no influence on the handle. For this reason built-in refrigeration devices have generally not had a door-opening aid available.

BRIEF SUMMARY OF THE INVENTION

The object of the invention is thus to create a refrigeration device with door-opening aid which is able to be realized as a built-in device or which does not demand any adaptation of a door handle to the existence of the door-opening aid.

The object is achieved in accordance with the invention by a refrigeration device of the type defined at the outset being provided with a sensor for detecting a movement of the door and a control circuit coupled to the sensor for activating the drive element on detection of the movement of the door. When the user begins to move the door in order to open it, even before the door-opening has led to the release of the contact between the seal and the other housing component, this action is detected by the control circuit, and the drive element is activated to move the door-out of its closed position.

As a result of an intuitively simple-to operate-design the seal is elastically expandable to allow the movement of the door away from the carcass before release of the contact between the seal and the other housing component, and the control circuit is configured to activate the drive element on detection of a movement of the door directed away from the carcass. I.e. when the user pulls on the door of the refrigeration device, as on the door of a conventional refrigeration device without a door-opening aid, so the resulting door movement is detected by the control circuit and the door-opening aid is activated.

In accordance with a second embodiment the seal is elastically compressible and the control circuit is configured to activate the drive element on detection of a movement of the door directed towards the carcass. Such an embodiment is especially user-friendly since it makes it possible for a user to open the door even if both their hands are full by simply pushing against the door, and then the drive element lets the door be opened. Naturally the control circuit can also be embodied to react both to the door being pulled as well as to pressure on the door.

There are various options for detecting such a movement of the door indicating a user's desire to open the door. In accordance with one embodiment a pressure sensor for detecting the pressure in the interior can be provided as the sensor. If the seal touches the other component of the housing to seal against it, both pulling on the door and pushing the door against the carcass leads to a change in pressure in the interior, which is able to be detected by the pressure sensor.

Changes in pressure can also arise in the interior if this heats up slowly in an idle phase of a refrigeration device or if it cools down slowly after the refrigeration device is put back into service. However such fluctuations in pressure play out on a time scale of several minutes whereas the fluctuations in pressure caused by the user play out within a few seconds. To suppress a reaction to slow fluctuations in pressure, the sensor can be connected to the control circuit via a highpass filter.

Other principles of the movement detection preferably operate with a sensor constructed in two parts, with one of the two interoperating parts of the sensor being connected to the carcass and the other to the door.

In particular the one part can be installed fixed relative to the carcass and the other relative to the door. It can also be useful for the one part to be installed on the one housing component and the other in an area movable by the elasticity of the seal against the one housing component. A further option is for a part of the sensor to be attached to a plunger guided movably on the one housing component and for the other to be attached to the one housing component itself.

The plunger can at the same time be part of the drive element.

A coil and a core made of ferromagnetic material can be provided as the said second parts of the sensor. A movement of the core influences the inductance of the coil and thus makes it possible to detect a movement of the door.

The core can also be permanently magnetic, so that a voltage induced by its movement in the coil can be detected as an indication of the movement of the door.

A Hall probe and a magnet can also be provided as the two parts of the sensor.

A further option is to use a capacitor as the sensor, with the two parts of the sensor being formed by its two electrodes.

To achieve a large extension of the electrodes and thereby a high capacitance it is useful for one of the electrodes to be conductor extending through a cavity in the seal.

In addition an optical distance sensor and a reflector surface for reflecting a beam of light emitted by the distance sensor are considered as the two parts of the sensor.

BRIEF DESCRIPTION OF THE DRAWINGS

Further features and advantages of the invention emerge from the subsequent description of exemplary embodiments which refer to the enclosed figures, in which.

DETAILED DESCRIPTION OF THE PRESENT INVENTION

Figure 1:
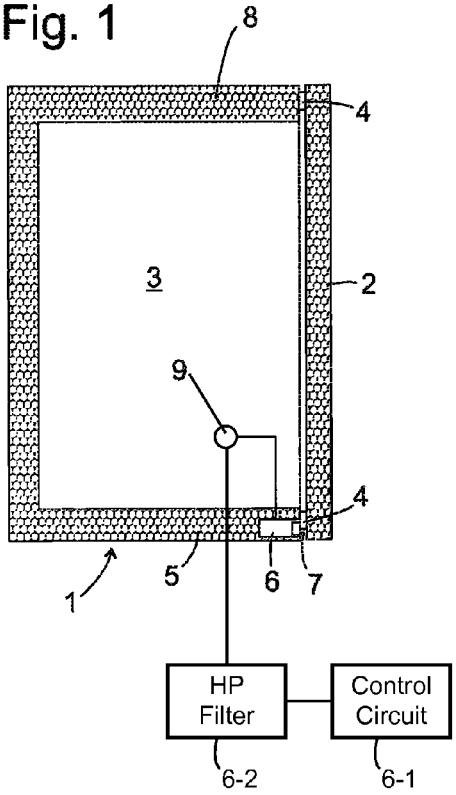
FIG. 1 shows a schematic section through an inventive refrigeration device.

FIG. 1 shows a greatly schematicized diagram of an inventive refrigeration device with a carcass 1 and a door 2 hinged thereon, which together delimit the interior 3. A magnetic seal 4 is attached all around the inner side of the door 2 and adheres by magnetic force essentially airtight to the front side of the carcass 1, so that a vacuum can form in the interior 3 if the door 2 is closed after warm air has penetrated into the interior 3 and the air in the interior 3 cools off.

Let into a heat insulating wall 5 forming the floor of the carcass 1 is a door-opening aid mechanism 6, the internal structure of which will be explained at a later point. Projecting from the door-opening aid mechanism 6 shown here in the inactive state is the tip of an actuator 7 which is located at a short distance from the inside of the door 2. The door-opening aid mechanism 6 could also be attached to any other wall of the carcass 1 at a distance from the hinge axis of the door 2; however placing it essentially centered in the floor 5 is preferred, as shown, or in a roof 8 of the carcass in order to guarantee that the door-opening aid mechanism 6 is effective regardless of the side of the carcass 1 on which the door 2 is closed.

A control circuit 6-1 in FIG. 1, which for example can be integrated into a housing of the door-opening aid mechanism 6 is connected to a pressure sensor 9 placed in the interior 3. The control circuit is designed—where necessary with the aid of a highpass filter 6-2 inserted between itself and the pressure sensor 9—to detect short-term fluctuations in pressure in the interior 3 and to react to these with an activation of the door-opening aid mechanism 6. Such a fluctuation in pressure can be a fall in pressure resulting from a user pulling on the door 2 and thereby stretching the sealing profile; however it can also be a rise in pressure which occurs when the sealing profile 16 is compressed by a user pushing against the door 2.

The structure and method of operation of an exemplary embodiment of the door-opening aid mechanism 6 will be explained more clearly on the basis of FIGS. 2 through 4 described below, which each show the lower edge area of the door 2 in an enlarged cross section. The door 2 is constructed here from an outer wall 10 formed from a metal panel and from a plastic deep-drawn inner wall 11, which are connected to each other at their vertical edges and enclose a cavity 12 filled with an insulating material. The cavity 12 is closed off at the top and bottom by profiles 13 made of plastic. A socket 14 to accommodate a hinge pin of a door hinge is formed into the profile 13.

Formed into an edge area of the inner wall 11 is a frame-shaped circumferential, undercut slot 15 into which a top section of a magnetic seal profile 16 is latched. The magnetic seal profile has a plurality of elongated chambers which lend it flexibility and of which one, labeled 17, is filled with a magnetic material, which holds a sealing surface of the sealing profile 16 pressed onto the front side of the carcass 1 made of sheet steel. The tip of the actuator 7 labeled 18 here lies at a slight distance from the inner edge of the profile 13.

Figure 2:
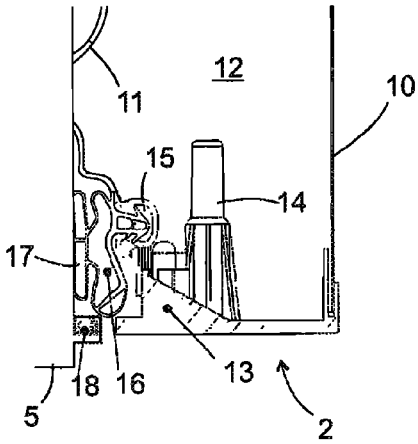
FIG. 2 shows a more detailed section through the lower edge of the door of the refrigeration device from FIG. 1 in the closed state of the door.
Figure 3:
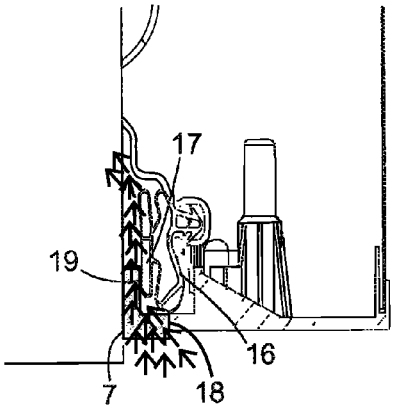
FIG. 3 a section corresponding to that depicted in FIG. 2 in a first phase of operation of the door-opening aid.

FIG. 3 shows a first phase of operation of the door-opening aid mechanism 6 let into the carcass 1. The actuator 7 is moved out of the carcass 1 far enough for a shoulder 19, which in the inactive state of FIG. 2 is flush with the forward edge of the carcass 1 or springs back behind it slightly, to project beyond this forward edge and push the chamber 17 filled with the magnetic material of the sealing profile 16 away from the carcass 1. Air can flow into the interior 3 of the refrigeration device through the gap thus produced to the side of the actuator 7 between carcass 1 and sealing profile 16, by which a pressure equalization between inside and outside is produced and to open the door 2 only the magnetic force acting between sealing profile 16 and carcass 1 still has to be overcome. In this phase the tip 18 still does not exert any perceptible force on the profile 13.

Figure 4:
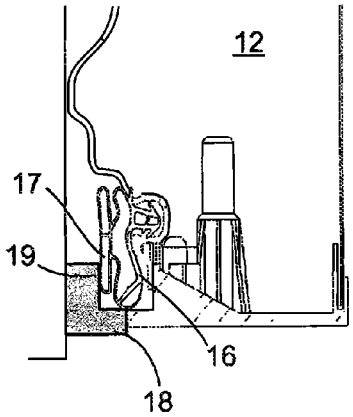
FIG. 4 a section corresponding to that depicted in FIG. 2 in a second phase of operation of the door-opening aid.

In the second phase of operation of the door-opening aid mechanism 6 shown in FIG. 4 the actuator 7 is moved even further out of the carcass 1, and by pressing the tip 18 against the profile 13 the sealing profile 16 is lifted away from the carcass 1. The door 2 can now be opened entirely freely. If the actuator 7 is driven strongly enough, it can accelerate the door 2 so strongly that the latter, after losing contact with the pressure element 18, opens automatically beyond the position shown in FIG. 4.

Figure 5:
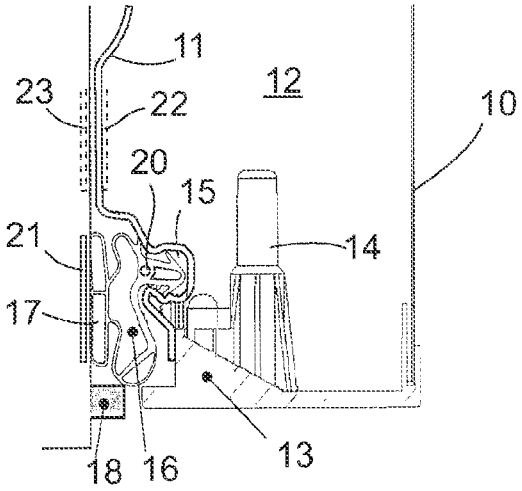
FIG. 5 a section similar to that depicted in FIG. 2 in accordance with a second embodiment.

FIG. 5 illustrates a second embodiment of the inventive refrigeration device with reference to a cross section similar to that shown in FIG. 2. One of the chambers of the magnetic seal profile 16 is filled out here by a wire 20, which extends over the entire length of the magnetic seal profile 16 and forms one plate of a capacitor, of which a second plate is formed by a metal band 21 which extends in the form of a frame along an area of the front side of the carcass 1 touched by the magnetic seal profile 16. In the embodiment shown in FIG. 5 the metal band 21 also lies opposite the magnetic material in the chamber 17 of the seal profile 16, so that the metal band 21 is expediently ferromagnetic and the magnetic force which holds the door 2 closed, acts between the magnetic material and the metal band 21. Otherwise the front side of the carcass 1 can be formed from non-conducting and non-magnetic plastic.

The capacitance of a capacitor formed from wire 20 and steel band 21 determines the frequency of an oscillating circuit (not shown), which is a part of the capacitor. This capacitance increases when the door 2 is pressed against the carcass 1 and during this process the magnetic seal profile 16 is compressed; it decreases when the door 2 is pulled and the magnetic seal profile 16 is stretched by this. The control circuit monitors the harmonic frequency and reacts to changes of the same by actuating the door-opening aid mechanism 6.

Alternatively the capacitor can be formed by two metal bands 22, 23 shown by dashed lines in FIG. 5, of which one extends in parallel to the magnetic seal profile 16 on the foam side of the inner wall 11 and the other 23 runs along the front side of the carcass 1. Here too the capacitor plates move against each other if the door 2 is pushed or pulled.

In accordance with a further variation the wire 20 and the metal band 21 or the two metal bands 22, 23 respectively can each be structured as coils with one or more windings, with alternating current being applied to one of these coils in each case and the other coil being coupled to the control circuit, so that this detects a voltage induced in the other coil by the alternating current. The amplitude of the induced voltage is likewise dependent on the gap between the two coils, so that both function as an inductive sensor for detecting a movement of the door 2.

Figure 6:
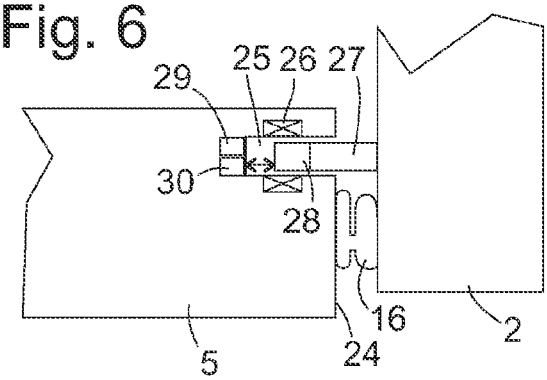
FIG. 6 a greatly schematicized section through the lower edge of the door and an adjoining floor panel of the carcass in accordance with a third embodiment.

FIG. 6 illustrates a third embodiment of the refrigeration device on the basis of a greatly simplified cross section through the lower edge of the door 2 and the forward edge of the bottom wall 5 adjoining it. Formed in the front edge 24 of the bottom wall 5 facing the door 2 is a cutout 25, around which a coil 26 extends. In the closed position of the door 2 a plunger 27 connected to the door 2 engages into the cutout 25, which at its tip bears a permanent magnet 28. Here too a movement caused by pushing or pulling the door 2 leads to a movement of the magnet to induce a voltage in the coil 26 which is detected by the control circuit and causes the latter to inject an excitation current into the coil 26 which generates an anti-parallel magnetic field to the magnetic field of the magnet 28 in this. The resulting force drives the door 2 away from the carcass 1, so that the door 2 is opened.

It is also possible to separate the functions of the movement detection and the drive of the door from each other, by for example the door movement detected as above on the basis of the voltage induced in the coil 26 being used to drive another actuator not shown in the figure for opening the door, or by a Hall probe 29 or an optical detector 30 being provided adjacent to the magnet 28 for movement detection, of which the emitted light beam is thrown back by the plunger 27. The optical detector 30 can for example employ interferometric measurement technologies, or it can simply detect the variable intensity of the light beam depending on the position of the plunger 27.

Instead of the magnet 28 a ferromagnetic element without its own magnetic moment can also be arranged at the tip of the plunger 27. In this case the coil 26 makes it possible to detect a door movement on the basis of its variable inductance depending on the position of the ferromagnetic element. A drive means for opening the door 2 is then to be provided separately from sensor formed by the coil 26 and the ferromagnetic element.

Figure 7:
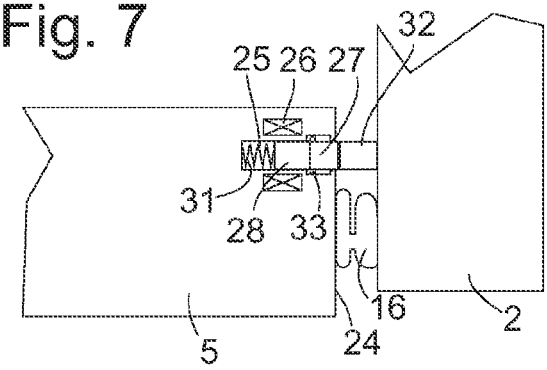
FIG. 7 a section similar to that depicted in FIG. 6 in accordance with a fourth embodiment.

FIG. 7 shows a variation of the embodiment from FIG. 6, in which the plunger 27 is not attached to the door 2, but is guided in the cutout 25 with narrow tolerances and is applied by a spring 31 to a projection 32 of the door 2. The freedom of movement of the plunger 27 is limited by a pin 33 interacting with the shoulders of the cutout 25. The physical separation of the plunger 27 from the door 2 makes it possible to guide it with narrow tolerances and thus improves the accuracy with which movement of the plunger 27—in accordance with any technology described in the example above with reference to FIG. 6—can be detected by being pressed by the spring 31 against the projection 32, the plunger 27 still remains coupled to the door 2 as regards movement.

The invention claimed is:

1. A refrigeration device comprising:

a carcass;

a door, the carcass and the door together delimiting an interior;

a seal, the seal being attached to one of the carcass and the door, and the seal, in a closed position of the door, engaging the other of the carcass and the door to provide a sealing function between the carcass and the door;

a drive element operable to drive the door out of the closed position into an opened position;

a pressure sensor configured to sense a movement of the door by sensing a change in pressure in the interior while the seal is sealed with the other of the carcass and the door; and a control circuit, operatively coupled to the pressure sensor to activate the drive element, while the seal is sealed with the other of the carcass and the door, in response to a sensed movement of the door.

2. The refrigeration device as claimed in claim 1, wherein the seal is elastically expandable and the control circuit is operable to activate the drive element in response to a sensed movement of the door directed away from the carcass.

3. The refrigeration device as claimed in claim 1, wherein the seal is elastically compressible and the control circuit is operable to activate the drive element in response to a sensed movement of the door directed towards the carcass.

4. The refrigeration device as claimed in claim 1, wherein the drive element is adapted to overcome a force resulting from a differential pressure between the interior and an exterior of the refrigeration device.

5. The refrigeration device as claimed in claim 1, wherein the sensed movement occurs while the seal is sealed with the other of the carcass and the door.

6. The refrigeration device as claimed in claim 1, wherein the control circuit is operatively coupled to the pressure sensor to activate the drive element in response to the sensed movement of the door while the seal is completely sealed with the other of the carcass and the door.

7. The refrigerator device as claimed in claim 1, wherein the pressure sensor is positioned within or at least partly on the carcass.

8. The refrigerator device as claimed in claim 1, wherein the refrigerator device is a built-in refrigeration device and the door is adapted to receive a décor cover and a handle attached to the décor cover.

9. The refrigeration device as claimed in claim 1, wherein the pressure sensor is coupled to the control circuit via a highpass filter.

10. A refrigeration device comprising:

a carcass;

a door, the carcass and the door together delimiting an interior;

a seal attached to one of the carcass and the door, the seal, in a closed position of the door, engaging the other of the carcass and the door to provide a sealing function between the carcass and the door;

a drive element operable to drive the door out of the closed position into an opened position;

a pressure sensor configured to detect the pressure in the interior, and a control circuit operatively coupled to the pressure sensor, adapted to detect short-term fluctuations in the pressure of the interior in order to sense a movement of the door, and adapted to activate the drive element while the seal is sealed with the other of the carcass and the door in response to a sensed movement of the door.

11. The refrigeration device as claimed in claim 10, wherein the seal is elastically expandable and the control circuit is operable to activate the drive element in response to a sensed movement of the door directed away from the carcass.

12. The refrigeration device as claimed in claim 10, wherein the seal is elastically compressible and the control circuit is operable to activate the drive element in response to a sensed movement of the door directed towards the carcass.

13. The refrigeration device as claimed in claim 10, wherein the pressure sensor is coupled to the control circuit via a highpass filter.

14. A method to operate a refrigeration device which comprises a carcass, a door, the carcass and the door together delimiting an interior, a seal attached to one of the carcass and the door, the seal, in a closed position of the door, engaging the other of the carcass and the door to provide a sealing function between the carcass and the door, a drive element operable to drive the door out of the closed position into an opened position, and a pressure sensor configured to detect the pressure in the interior, the method comprising sensing a movement of the door, while the seal is sealed with the other of the carcass and the door, caused by a pushing or pulling on the door by sensing a change in pressure in the interior with the pressure sensor, and activating the drive element, while the seal is sealed with the other of the carcass and the door, in response to the sensed movement of the door.

* * * * *